US006672225B2

(12) United States Patent
Pomodoro

(10) Patent No.: US 6,672,225 B2
(45) Date of Patent: Jan. 6, 2004

(54) HEIGHT AND TILT ADJUSTABLE WORKSTATION

(75) Inventor: Leonardo A. Pomodoro, Kalamazoo, MI (US)

(73) Assignee: The Board of Trustees of Western Michigan University, Kalamaloo, MI (US)

( * ) Notice: Subject to any disclaimer, the term of this patent is extended or adjusted under 35 U.S.C. 154(b) by 63 days.

(21) Appl. No.: 10/119,334

(22) Filed: Apr. 9, 2002

(65) Prior Publication Data

US 2003/0188671 A1 Oct. 9, 2003

(51) Int. Cl.[7] ..... A47F 5/12
(52) U.S. Cl. ..... 108/8; 108/50.02
(58) Field of Search ..... 108/50.02, 5, 6, 108/7, 8, 20, 138; 312/223.3, 194, 196, 319.5–319.8; 297/325; 248/371, 398

(56) References Cited

U.S. PATENT DOCUMENTS

| | | | | | |
|---|---|---|---|---|---|
| 1,184,594 | A | | 5/1916 | von Nagy | |
| 3,494,306 | A | | 2/1970 | Aguilar | |
| 3,603,545 | A | | 9/1971 | Boniface | |
| 4,177,739 | A | | 12/1979 | Phelps | |
| 4,611,777 | A | * | 9/1986 | Ireland et al. | 248/371 |
| 4,681,042 | A | * | 7/1987 | Roberts | 108/6 |
| 4,819,986 | A | * | 4/1989 | Markus | 297/325 |
| 4,947,763 | A | | 8/1990 | Piorek | |
| 5,138,955 | A | | 8/1992 | Manner | |
| 5,460,104 | A | | 10/1995 | Young, Sr. | |
| 5,544,594 | A | | 8/1996 | Schairbaum | |
| 5,577,806 | A | | 11/1996 | Ugalde | |
| 5,586,508 | A | * | 12/1996 | Bahr | 108/2 |
| 5,790,996 | A | * | 8/1998 | Narfstrom | 5/610 |
| 6,056,363 | A | * | 5/2000 | Maddox | 297/325 |
| 6,273,389 | B1 | * | 8/2001 | Carlgren | 248/371 |

* cited by examiner

*Primary Examiner*—Janet M. Wilkens
(74) *Attorney, Agent, or Firm*—Flynn, Thiel, Boutell & Tanis, P.C.

(57) ABSTRACT

The present invention is directed to a workstation having a base including two spaced apart arcuate legs having a common first radius. A worksurface support assembly is supported on the base and includes two spaced apart arcuate supports. Each support has a common second radius that is equal to the common first radius of the legs. Elongate slots extend through each of the supports. Each of the legs has a central segment that is received in a respective one of the elongate slots in the supports. Each of the supports includes an arcuate member that is slidably fitted on a support track. A worksurface is secured to and supported by the arcuate members. A lift assembly is provided and is configured to move the worksurface support assembly in a generally horizontal direction with respect to the base to vertically adjust the worksurface between upper and lower elevational positions.

10 Claims, 15 Drawing Sheets

HEIGHT AND TILT ADJUSTABLE WORKSTATION

FIELD OF THE INVENTION

This invention relates generally to adjustable workstations and, more particularly, to an adjustable workstation having a lift assembly configured to move a worksurface support assembly in a generally horizontal direction to vertically adjust the worksurface between upper and lower elevational positions.

BACKGROUND OF THE INVENTION

A variety of workstations have been developed over the years. While traditional workstations were suitable for their intended purpose, they were lacking in versatility. For instance, traditional workstations traditionally had only one elevational position. Thus, persons of all sizes had to conform to these "one size fits all" workstations.

In recent years, manufacturers of office furniture have addressed this issue by making adjustable chairs and workstations that are designed to improve the ergonomics of office settings. Some workstations currently available have worksurfaces that are vertically adjustable to accommodate persons of numerous sizes. While these workstations have provided a more comfortable work environment for many workers, there exists room for improvement in the design of these devices.

SUMMARY OF THE INVENTION

This invention is directed to a new and useful workstation having a base including first and second spaced apart arcuate legs having a common first radius. A worksurface support assembly is supported on the base and includes first and second spaced apart arcuate supports. Each support has a common second radius that is equal to the common first radius of the first and second legs. Elongate slots extend through each of the first and second supports. Each of the first and second legs has a central segment that is received in a respective one of the elongate slots in the first and second supports. Each of the supports includes an arcuate member that is slidably fitted on a support track. A worksurface is secured to and supported by the arcuate members. A lift assembly is provided and is configured to move the worksurface support assembly in a generally horizontal direction with respect to the base to vertically adjust the worksurface between upper and lower elevational positions.

BRIEF DESCRIPTION OF THE DRAWINGS

This invention is pointed out with particularity in the accompanying claims. The above and further features and benefits of this invention are better understood by reference to the following detailed description, as well as by reference to the following drawings in which:

DETAILED DESCRIPTION

Figure 1:
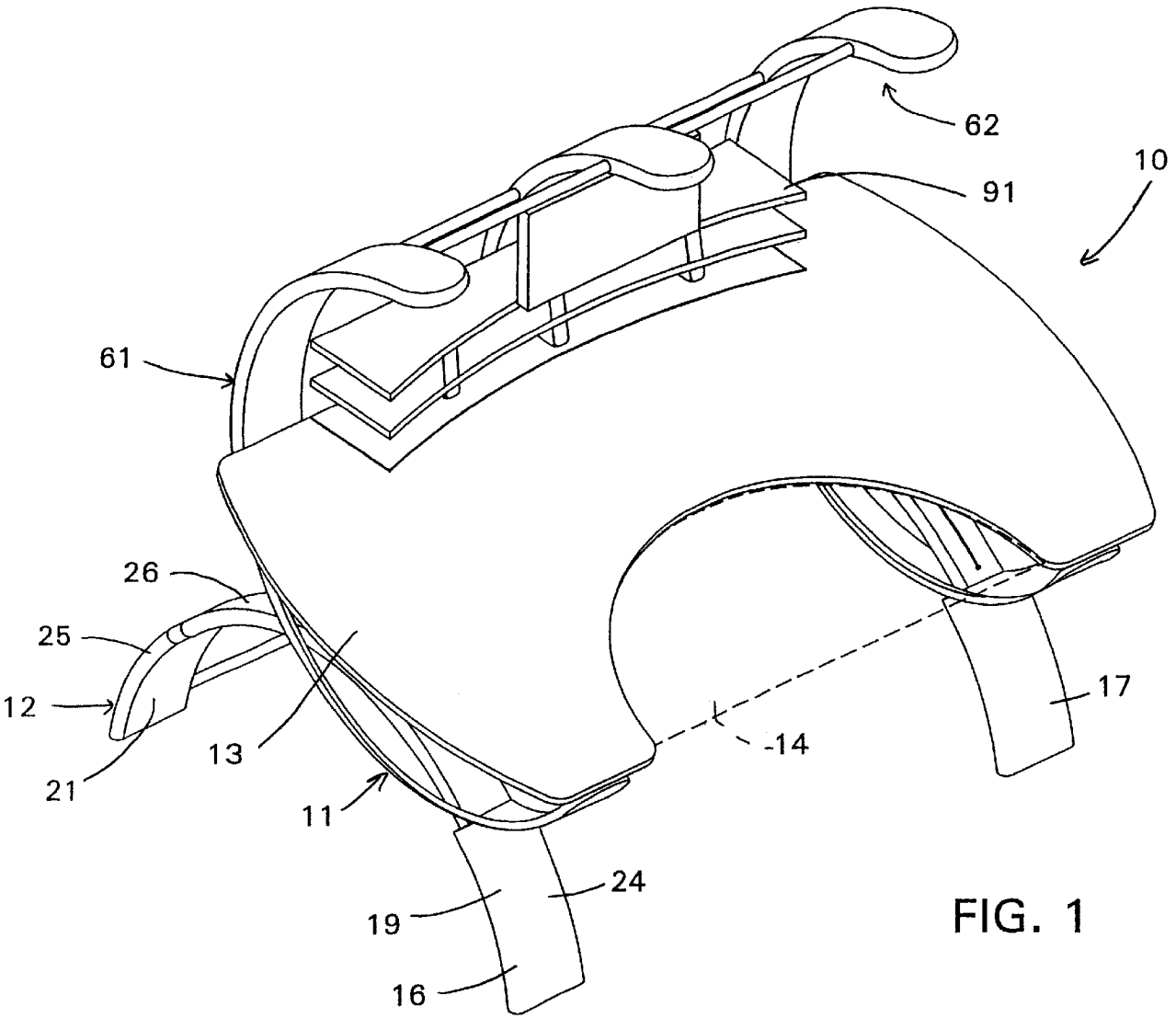
FIG. 1 is a perspective view of a workstation according to the present invention in its highest elevational position.
Figure 2:
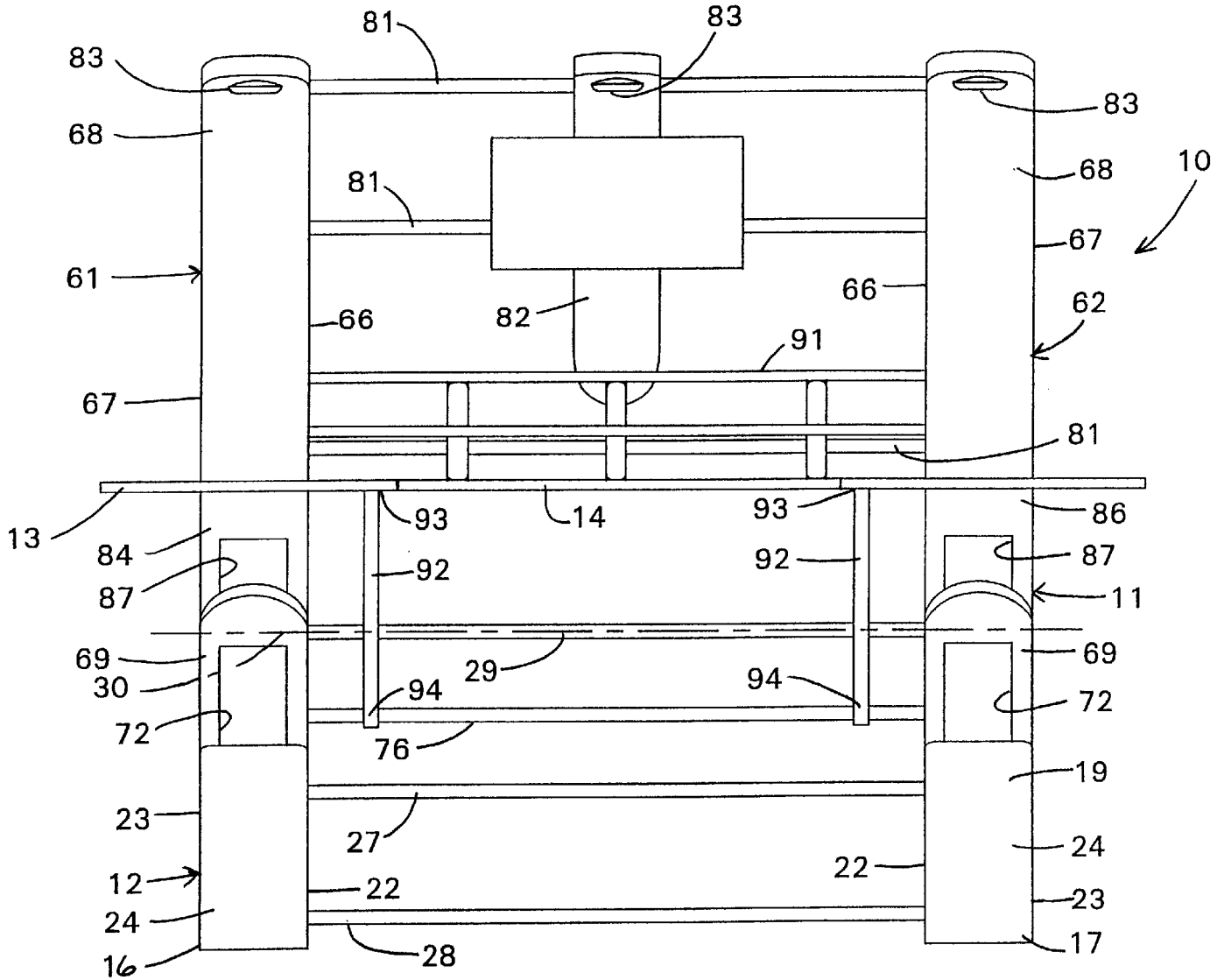
FIG. 2 is a front view of the workstation of FIG. 1.

Referring to FIGS. 1 and 2 there is illustrated a workstation 10 according to the present invention. The workstation 10 includes a worksurface support assembly 11 that is supported by a base 12. The worksurface support assembly 11 carries a worksurface 13. The worksurface 13 preferably includes a movable keyboard shelf 14 which has been schematically illustrated in broken lines in FIG. 1.

Figure 3A:
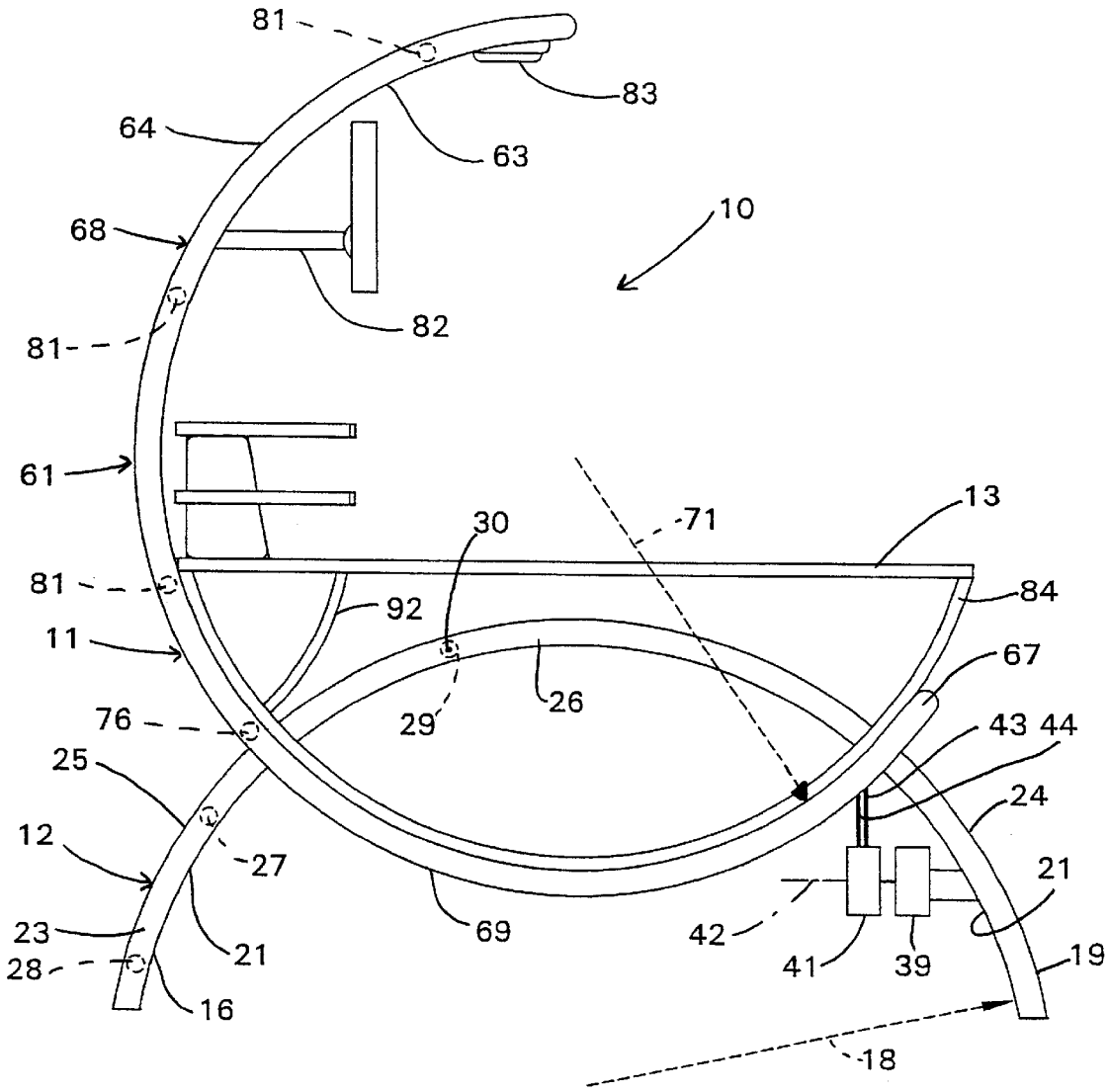
FIG. 3A is a side view of the workstation of FIG. 1.
Figure 3B:
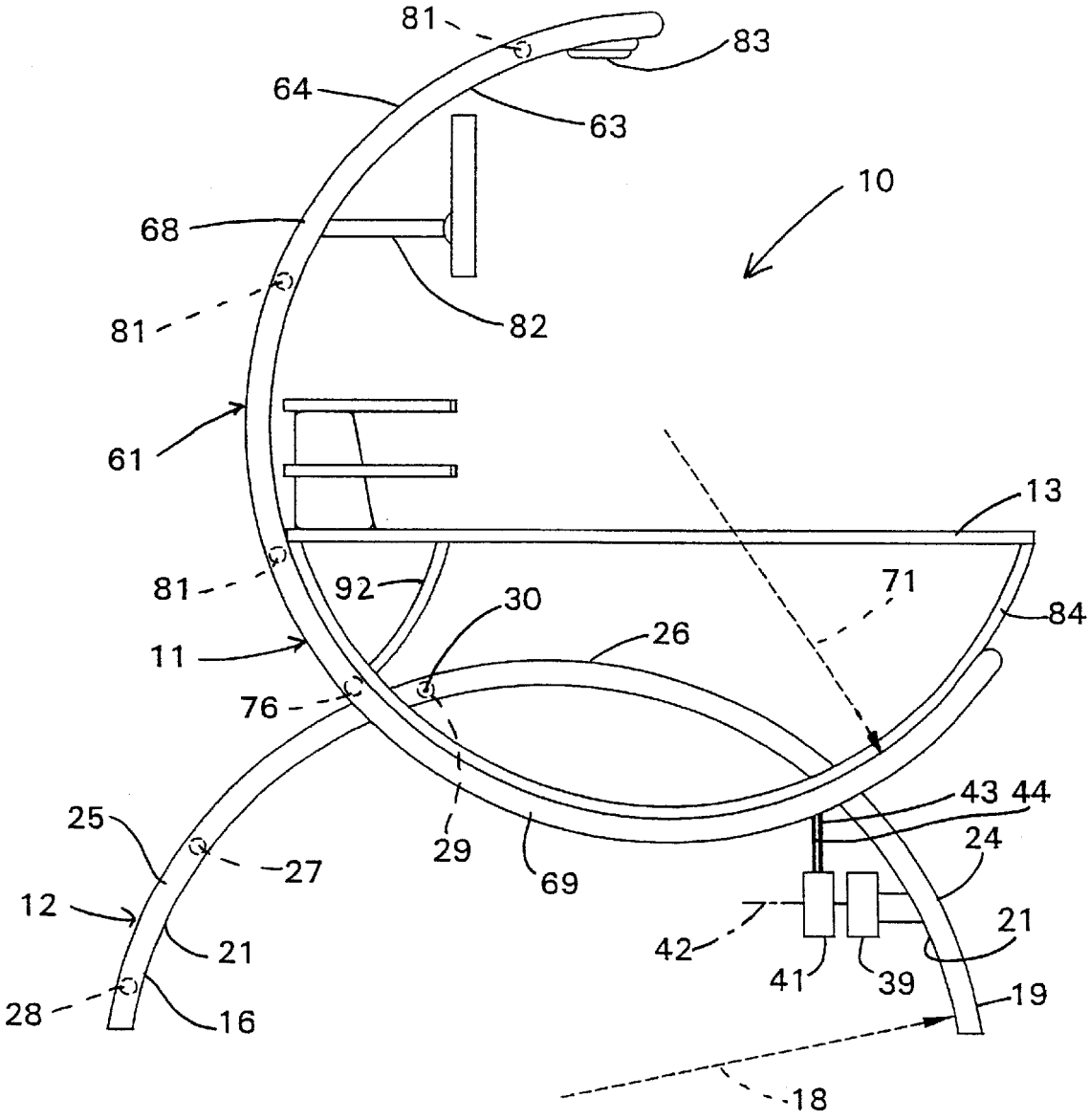
FIG. 3B is a side view of the workstation of FIG. 1 in its highest elevational position.

Referring in addition to FIGS. 3A and 3B, the base 12 includes left and right spaced apart arcuate legs 16 and 17 (FIG. 2) that have a common radius 18. Each leg 16 and 17 has a top surface 19 and a bottom surface 21 and inner and outer facing edge surfaces 22 and 23 (FIG. 2). Each leg 16 and 17 also includes front and back end segments 24 and 25 that contact the floor. The front and back end segments 24 and 25 of each leg 16 and 17 have a uniform width and are separated by a narrow width central segment 26. The segments 24, 25 and 26 are of a uniform thickness.

Figure 7A:
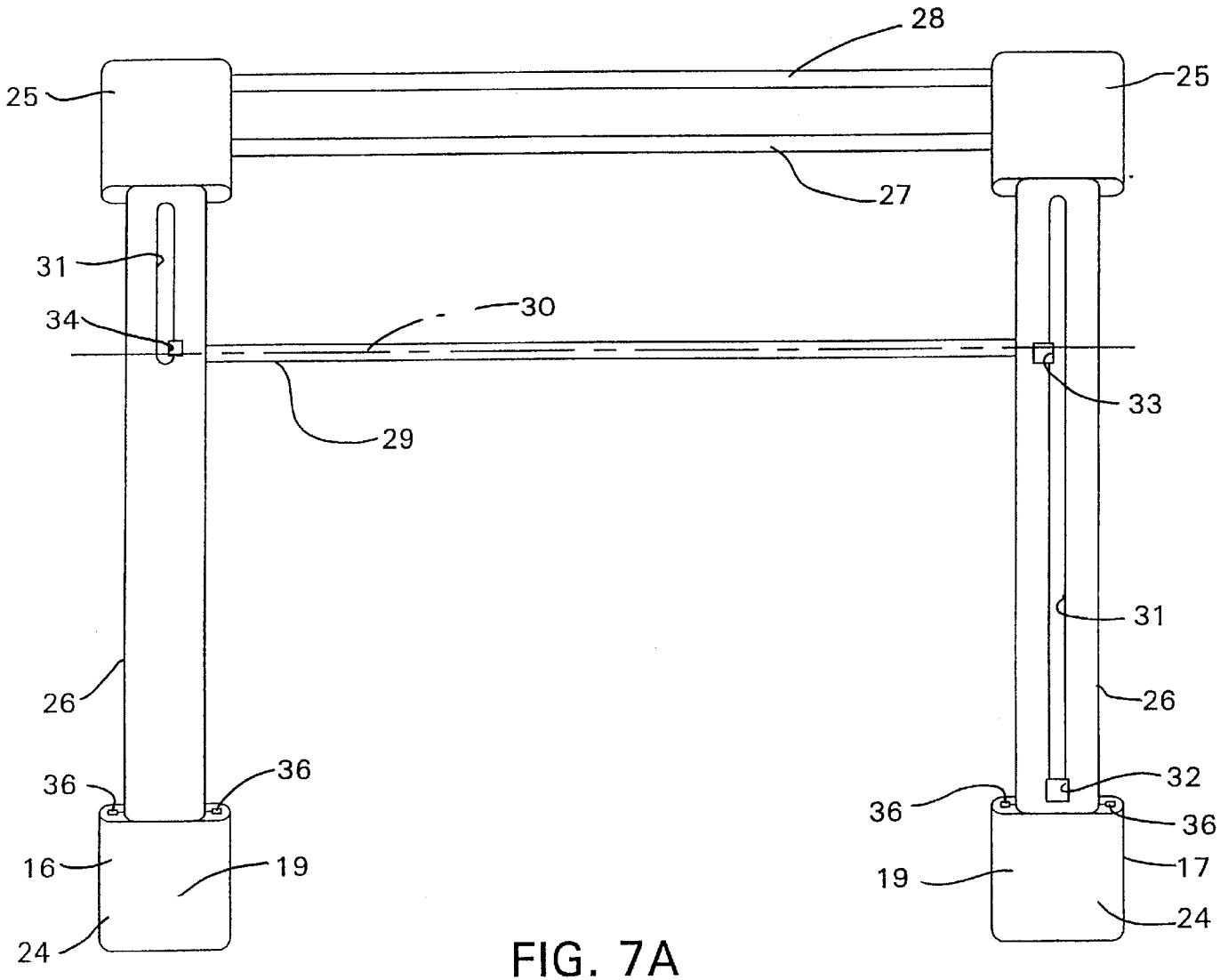
FIG. 7A is an elevational view of the base of the workstation of FIG. 1.

The legs 16 and 17 are coupled to one another by a pair of elongate rods 27 and 28 (FIGS. 2 and 7A) that extend between the back end segments 25 of the legs 16 and 17. A hollow rod 29 having a longitudinal axis 30 (FIG. 2) extends between the central segment 26 of the legs. Preferably, the hollow rod 29 is attached to the central segment 26 of the legs 16 and 17 at a generally more rearwardly location so it effects a minimal reduction in space beneath the worksurface 13 for the legs of a person seated at the workstation 10. An elongate slot 31 (FIG. 7A) is defined along the center of the top surface 19 of each leg 16 and 17. The width of the slot 31 has been exaggerated herein for the purposes of illustration only. Referring to FIG. 7A, a bore 32 extends through the central segment 26 of the right leg 17 near the front of the workstation 10. A bore 33 extends through the right leg central segment 26 near the rear of the workstation. As illustrated, the center of the bore 33 is located just forward of the hollow rod 29. A bore 34 extends through the left leg central segment 26 near the rear of the workstation. The center of the bore 34 is located just rearward of the hollow rod 29.

Figure 4:
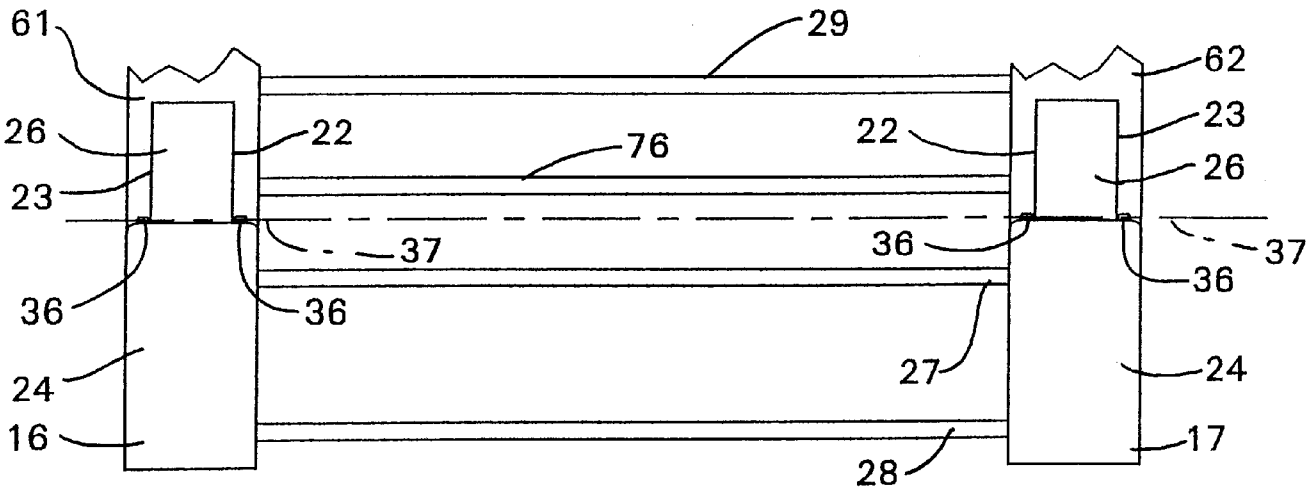
FIG. 4 is an enlarged front view of the workstation of FIG. 1, illustrating the front roller bearings.

Referring to FIG. 4, a pair of front roller bearings 36 are attached to the central segment 26 of each leg 16 and 17 slightly above the respective front end segment 24. One front roller bearing 36 is oriented on each of the inner and outer facing edge surfaces 22 and 23 of the central segment 26. The front roller bearings 36 are aligned along a common rotation axis 37. Each bearing 36 is positioned so that the outer surface thereof does not contact the respective front end segment 24 when the bearing 36 rotates about the rotation axis 37.

Referring to FIGS. 3A and 3B, a motor 39 is mounted on the bottom surface 21 of the right leg front end segment 24. The motor 39 is preferably a planetary gear motor, however, any suitable motor could be used. A cable drum 41 is mounted on the bottom surface 21 of the right leg front end segment 24 above the motor 39. The cable drum 41 is configured to rotate about a horizontal axis 42. The motor 39 is configured to drive the cable drum 41 in both clockwise and counterclockwise directions about the axis 42. Two cables 43 and 44 are wound around the cable drum 41.

Figure 7B:
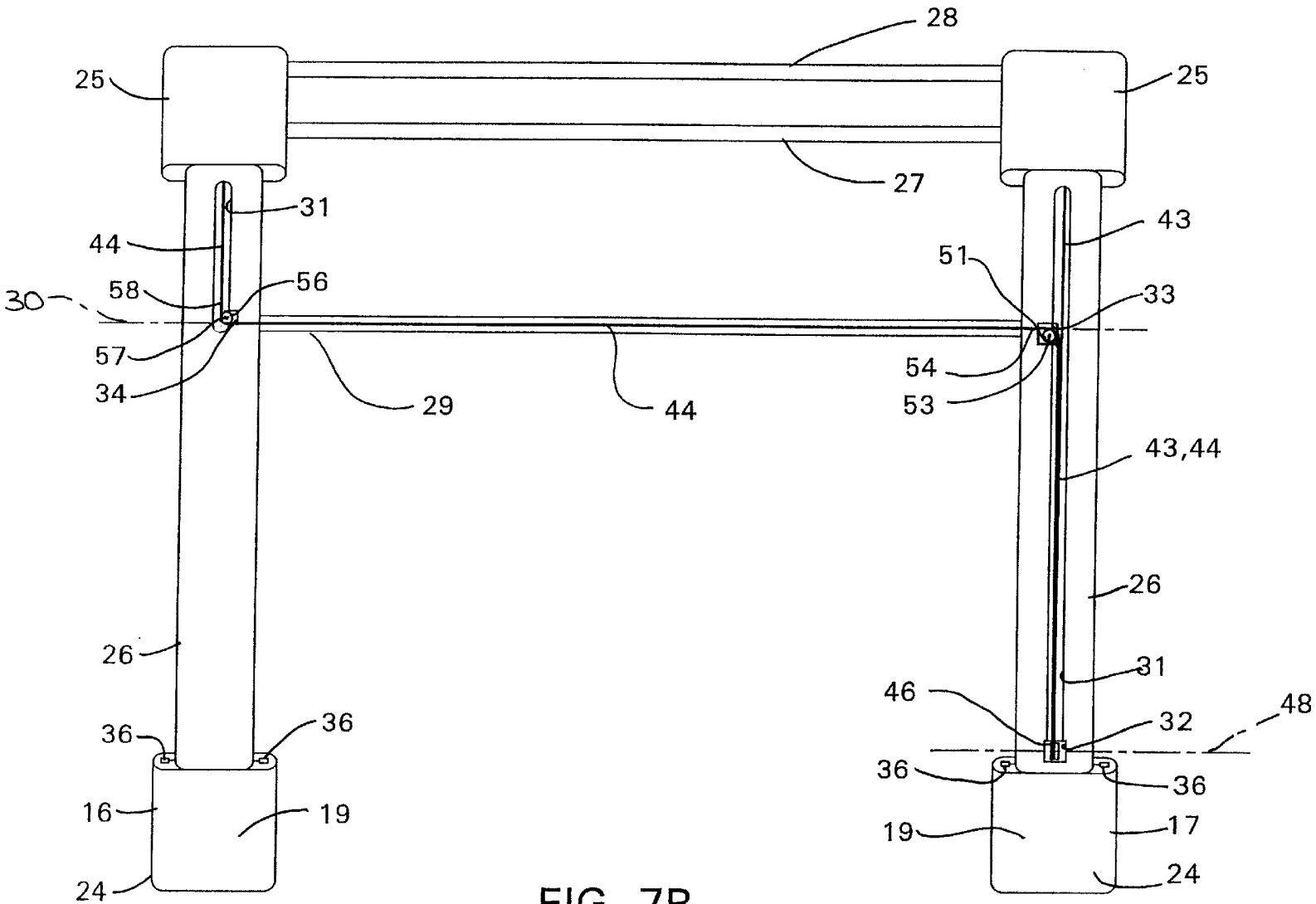
FIG. 7B is an elevational view of the base of the workstation of FIG. 1 illustrating the pulley and cable system.
Figure 8:
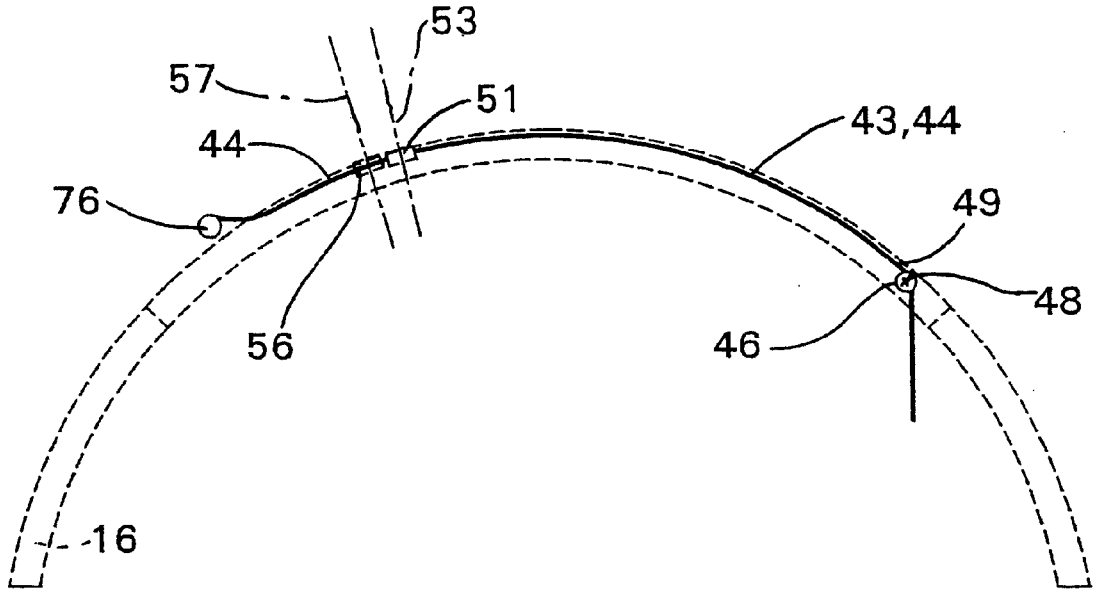
FIG. 8 is a schematic view of the pulley and cable system of FIG. 7B.

As illustrated in FIG. 7B, the workstation 10 includes a pulley system that is attached to the legs 16 and 17. A schematic representation of the pulley system of workstation 10 is illustrated in FIG. 8. A first pulley 46 is attached to the right leg 17 and positioned in the bore 32. The first pulley 46 is configured to rotate in a vertical theoretical plane of rotation about a generally horizontal rotation axis 48. The cables 43 and 44 extend upward from the cable drum 41 (FIG. 8) through the bore 32 and pass over the first pulley 46. The cables 43 and 44 extend over the first pulley 46 along a tangent 49 (FIG. 8B) and over the slot 31.

A second pulley 51 is positioned in the bore 33 near the rear of the central segment 26 of the right leg 17 whereat the hollow rod 29 is adjoined. The second pulley 51 is configured to rotate in a theoretical plane of rotation which is parallel to the top surface 19 of the leg 17 at the location where the pulley 51 is positioned. The pulley 51 rotates about a rotation axis 53 (FIG. 8) which is perpendicular to the top surface 19 of the leg 16 at the location where the pulley 51 is positioned. The second pulley 51 is positioned so the rotation axis 53 is offset from the first pulley tangent 49, as illustrated in FIG. 7B. The cable 44 passes around the second pulley 51 and extends out from the second pulley along a tangent 54 which is aligned along the longitudinal axis 30 of the hollow rod 29. The cable 44 extends through the hollow rod 29 toward the left leg 16. As illustrated in FIG. 7B, the cable 43 does not wind around the second pulley 51 and instead continues along the right leg 17 in the slot 31.

A third pulley 56 is positioned in the bore 34 near the rear of the left leg central segment 26. The third pulley 56 is configured to rotate in a theoretical plane of rotation which is parallel to the top surface 19 of the leg 16 at the location where the third pulley 56 is positioned. The third pulley 56 is rotational about a rotation axis 57 which is perpendicular to the top surface 19 of the leg 16 at the location where the third pulley 56 is positioned. As illustrated in FIG. 7B, the third pulley 56 is positioned so the rotation axis 57 is rearward of the longitudinal axis 30 of the hollow rod 29. The cable 44 extends through the hollow rod 29 and passes around the third pulley 56. The cable 44 extends out from the third pulley 56 along a tangent 58 which is aligned with the left leg slot 31 and is directed toward the rear of the left leg 16.

Returning to FIGS. 1 and 2, the worksurface support assembly 11 includes left and right arcuate support tracks 61 and 62. The support tracks 61 and 62 have radially inwardly and outwardly facing surfaces 63 and 64 (FIGS. 3A and 3B) and laterally inner and outer facing edges 66 and 67 (FIG. 2). Each support track 61 and 62 includes an upper arc segment 68 and a lower arc segment 69. The upper and lower arc segments 68 and 69 can be segments of a single element support, as illustrated herein. Alternatively, they could be separate components that are removably attached to one another. As illustrated in FIGS. 3A and 3B, the lower arc segments 69 have a common radius 71 that is equal to the radius 18 of each of the legs 16 and 17 of the base 12. An elongate slot 72 (FIG. 2) extends through the lower arc segment 69 of each support track 61 and 62. A number of openings 73, illustrated in broken lines in FIG. 9, extend through the radially inwardly facing surface 63 of the right support track 62. The openings 73 extend along the inwardly facing surface 63 of the lower arc segment 69 on one side of the elongate slot 72.

Figure 5:
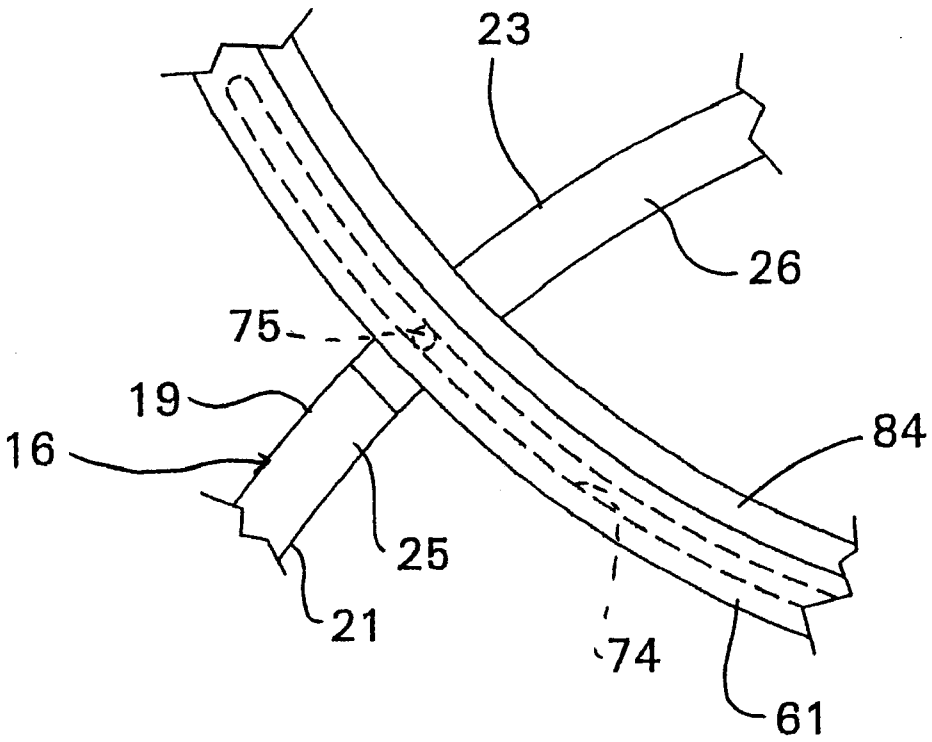
FIG. 5 is an enlarged side view of the workstation of FIG. 1, illustrating the arcuate support track bearings.

As illustrated in FIG. 5, an elongate groove 74 is formed in the support track 61 along a rearward segment of the elongate slot 72. An identical groove 74 is formed in the support track 62 along a rearward segment of the corresponding slot 72 (not shown). A bearing 75 is located in each groove 74. When the support tracks 61 and 62 move with respect to the legs 16 and 17, each bearing 75 rolls in the associated groove 74 along the respective leg 16 and 17.

Figure 6:
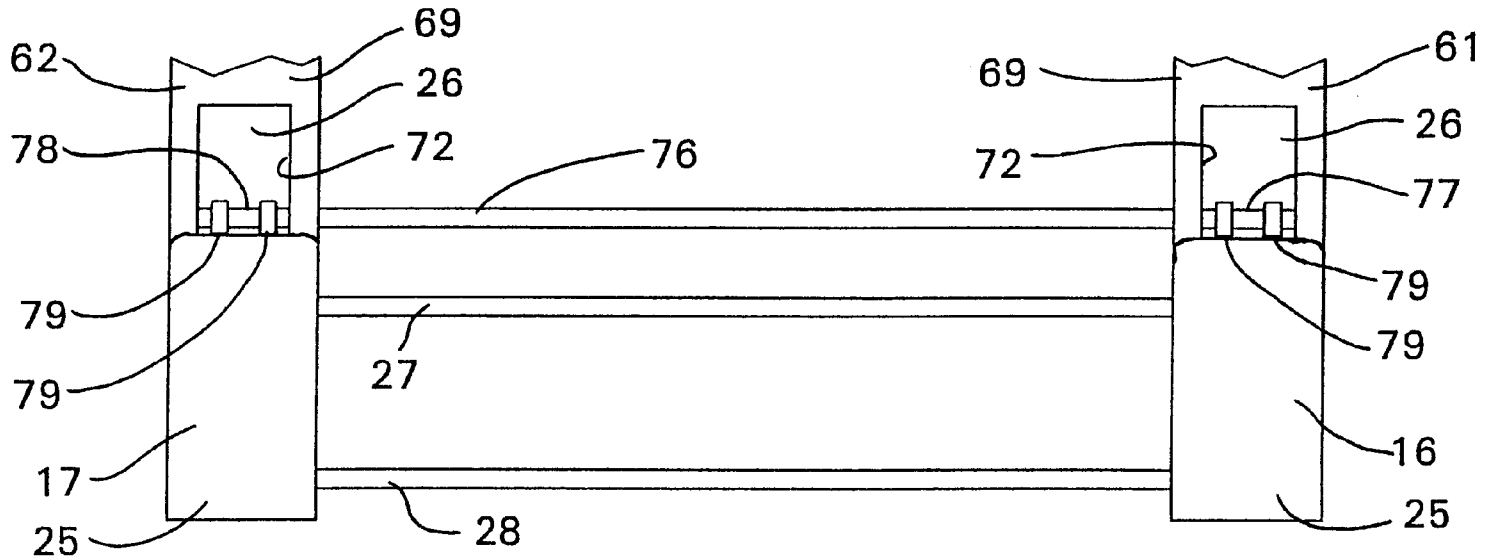
FIG. 6 is an enlarged back view of the workstation of FIG. 1, illustrating the back roller bearings.

Referring to FIG. 6, a rod 76 extends between the lower arc segments 69 of the support tracks 61 and 62. A first end 77 of the rod 76 extends through the left support track 61 and a second end 78 of the rod 76 extends through the right support track 62. As illustrated, a portion of the first end 77 is exposed in the slot 72 of the left support track 61. Similarly, a portion of the second end 78 is exposed in the slot 72 of the right support track 62. Two back roller bearings 79 are rotatably mounted to the first end 77 of the rod 76 and are positioned in the elongate slot 72 of the left support track 61. Likewise, two back roller bearings 79 are rotatably mounted to the second end 78 of the rod 76 and are positioned in the elongate slot 72 of the right support track 62.

Returning to FIG. 2, a number of horizontally oriented rods 81 extend between the upper arc segments 68 of the support tracks 61 and 62. A computer monitor support 82 is suspended from the rods 81. The computer monitor support is preferably configured to support a flat screen monitor, such as that illustrated herein. When the workstation 10 is configured as illustrated, the monitor support 82 can slide along the rods 81 to allow a supported computer monitor to be positioned in any desired location by a user. In addition, a number of lights 83 can be provided on the worksurface support assembly 11 as illustrated.

Figure 9:
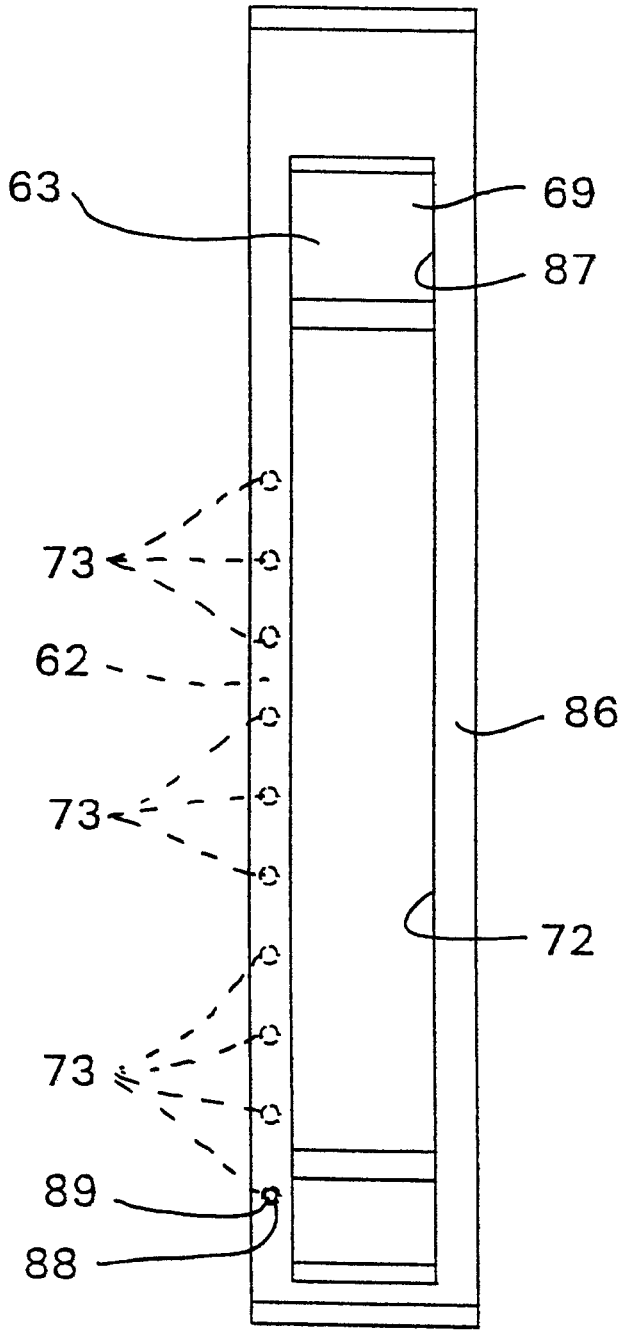
FIG. 9 is an enlarged elevational view of the right arcuate member of the workstation of FIG. 1 illustrating the tilt assembly.

Referring in addition to FIGS. 3A and 3B, left and right arcuate members 84 and 86 (FIG. 2) are slidably fitted radially inside of the lower arc segment 69 of respective ones of the left and right support tracks 61 and 62. An elongate slot 87 (FIG. 2) extends through each arcuate member 84 and 86. The width of the elongate slot 87 of each arcuate member 84 and 86 is equal to the width of the elongate slot 72 in each lower arc segment 69, however, as illustrated in FIG. 9, the elongate slots 87 in the arcuate members 84 and 86 are longer than the elongate slots 72 in each lower arc segment 69. A bore 88 (FIG. 9) extends through the right arcuate member 86 near the front of the workstation 10 and receives therein a pin 89 (FIG. 9). The pin 89 is of a sufficient length to extend through the entire thickness of the right arcuate member 86 and into one of the openings 73 in the right support track 62.

Figure 10:
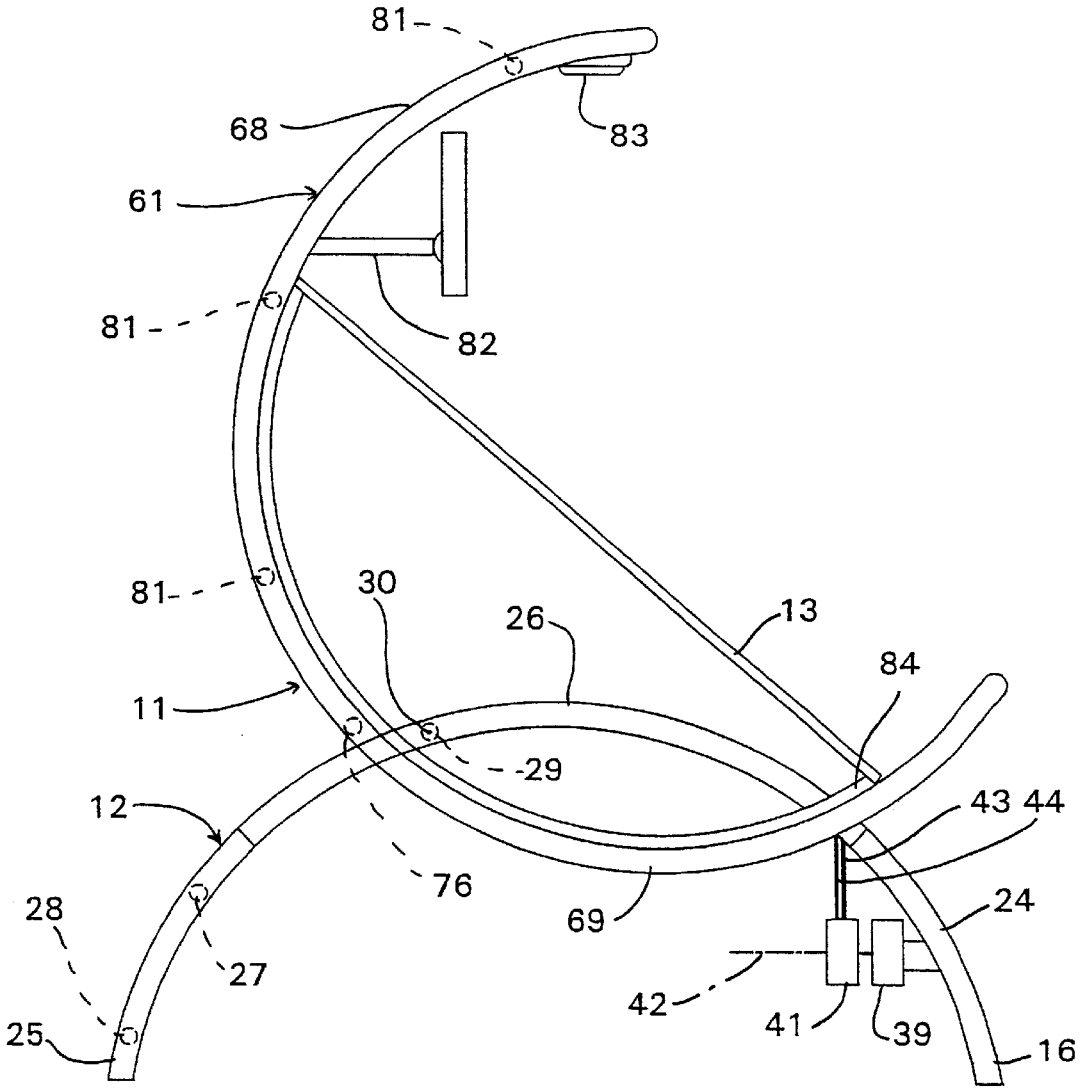
FIG. 10 is a side view of the workstation of FIG. 1 with the worksurface in its full tilt position.

The arcuate members 84 and 86 support thereon the workstation worksurface 13 (FIG. 2). As illustrated in FIG. 2, the worksurface 13 can include a shelving unit 91. The shelving unit 91 can be removable if desired, such as when the worksurface 13 is in a tilted position (FIG. 10). The shelving unit 91 is supported by two shelving supports 92. Each shelving support 92 has a first end 93 that is attached to the bottom of the shelving unit 91 and a second end 94 which is attached to the rod 76 (FIGS. 2, 3A and 3B). The worksurface 13 can be secured to the arcuate members 84 and 86 in any suitable manner. The manner of attachment may be dependent, at least in part, on the material used for the worksurface 13 and the arcuate members 84 and 86. For instance, if the worksurface 13 is composed of glass, an epoxy or other adhesive could be used to fix the worksurface 13 to arcuate members 84 and 86 composed of any number of materials, such as wood, glass or plastic. If both the worksurface 13 and the arcuate members 84 and 86 are composed of wood, the worksurface 13 could instead be bolted to the arcuate members 84 and 86.

To assemble the base of the workstation 10, the front roller bearings 36 are affixed to the central segments 26 of each leg 16 and 17. The elongate rods 27 and 28 are attached to the back end segments 25 of the right leg 17. The pulleys 46, 51 and 56 are then positioned in their respective bores 32, 33 and 34. The cables 43 and 44 are pulled upward from the cable drum 41 through the bore 32 and over the pulley 46. the cables 43 and 44 are then guided rearward along the elongate slot 31 in the right leg 17. The cable 43 avoids the second pulley 51 and continues rearward through the slot 31. The cable 44 passes around the second pulley 51. The hollow rod 29 is attached to the central segment 26 of the right leg 17 and the cable 44 is inserted through the hollow rod 29. The hollow rod 29 and the elongate rods 27 and 28 are attached to the left leg 16. The cable 44 is pulled through the bore 34, around the third pulley 56 and rearward along the left leg 16 in the slot 31.

To assemble the worksurface support assembly 11, the elongate rod 76 is partially inserted into the left and right support tracks 61 and 62. Once the first end 77 extends into the slot 72 of the left support track 61, a first back roller bearing 79 is mounted on the rod end 77. The cable 44 is then attached to the rod 76, either by tying the end of the cable to the rod end 77 or by another suitable method. A second back roller bearing 79 is then mounted on the rod end 77. When assembled, one back roller bearing 79 will be positioned on the rod end 77 on either side of the cable 44 attachment point. Similarly, the second end 78 of the rod 76 is inserted into the right support track 62 so that the second end 78 extends into the slot 72. Once the second end 78 in exposed in the slot 72, the back roller bearings 79 are mounted on the rod second end 78 and the cable 43 is attached to the rod end 78 in a manner consistent with attachment to the first end 77. The rods 27 and 28 are then attached to the right leg 17. The support tracks 61 and 62 are then moved together so that the ends of the elongate rod 76 are no longer exposed in the slots 72 and the rods 27 and 28 extend into the left leg 16. The arcuate members 84 and 86 are then fitted into their respective support tracks 61 and 62. If the worksurface 13 is not already attached to the arcuate members 84 and 86, it can be fixed to the arcuate members at this time. Alternatively, the worksurface 13 can be secured to the arcuate members 84 and 86 once the remainder of the workstation 10 is assembled.

The worksurface support assembly 11 is positioned on the base 12 so that the left leg central segment 26 is received in the slots 72 and 87 of the left support track 61 and left arcuate member 84 and the right leg central segment 26 is received in the slots 72 and 87 of the right support track 62 and right arcuate member 86. The cable 43 extending along the right leg 17 is attached to the rod end 78 exposed in the slot 72, preferably between the back roller bearings 79. The cable 44 extending along the left leg 16 is similarly attached to the rod end 77 exposed in the slot 72 between the back roller bearings 79.

OPERATION

When a change in the elevational position of the workstation 10 is desired, the motor 39 is actuated to rotate the cable drum 41 in the appropriate direction. To move the workstation 10 toward its lower position, the cable drum 41 is driven to rotate in a clockwise direction so that the tension in the cables 43 and 44 is reduced. The worksurface support assembly 11 can then slide rearward. As the worksurface support assembly 11 slides, the front roller bearings 36 roll along the outwardly facing surfaces 64 of the left and right support tracks 61 and 62. The back roller bearings 79 roll along the top surface 19 of the central segments 26 of the left and right legs 16 and 17. Additionally, the bearings 75 roll along the legs 16 and 17 in the grooves 74 of the left and right support tracks 61 and 62.

As the worksurface support assembly 11 slides rearward from, for example, the FIG. 3B position toward the FIG. 3A position, the worksurface 13 is moved downward. Since the radius 18 of each leg 16 and 17 is equal to the radius 71 of the respective lower arc segment 69, the worksurface 13 will not tilt rearward when the worksurface support assembly 11 moves rearward. Instead, the worksurface 13 will remain in its initial tilt position but will be moved to a lower elevational position. Once the worksurface 13 is lowered to the desired location, the motor 39 is deactivated, causing rotation of the cable drum 41 to cease. If the motor 39 is a planetary gear motor, the interaction of the internal gears will cause the cable drum 41 to be locked in position when the motor 39 is deactivated. Alternatively, the motor 39 can include an integrated mechanism to lock the cable drum 41 in the desired position when the motor 39 is deactivated. When the cable drum 41 is locked in position, the worksurface support assembly 11 will be prevented from further moving with respect to the base 12 toward a lower elevational position.

To move the workstation 10 toward its upper elevational position, the motor 39 is actuated to rotate the cable drum 41 in a counterclockwise direction. The cables 43 and 44 are then wound around the cable drum 41. As the cables 43 and 44 are tensioned, they exert a force on the rod 76, causing the support tracks 61 and 62, and thus the worksurface support assembly 11, to move forward with respect to the base 12. This forward movement of the worksurface support assembly 11 results in an upward movement of the worksurface 13. Once again, due to the relationship between the radii 18 of the legs 16 and 17 and the radii 71 of the lower arc segments 69 of the support tracks 61 and 62, the worksurface 13 will not be tilted by the movement of the worksurface support assembly 11. Instead, the worksurface 13 will be moved to a higher elevational position while remaining in its original tilt orientation. Once the worksurface 13 is raised to its desired position, the motor 39 is deactivated, ending rotation of the cable drum 41 and preventing further adjustment of the worksurface 13. It should be appreciated that the motor 39 should include an automatic shut-off feature to prevent the worksurface support assembly 11 from moving forward to a position in which the rod 76 moves over the pulleys 51 and 56. Movement of the rod 76 to such a position would cause the cable 44 to be removed from the pulley 56 and cause possible entanglement between the cables 43 and 44 near the pulley 51.

To adjust the tilt of the worksurface 13 to a position such as illustrated in FIG. 10, the pin 89 is pulled upward until it is disengaged from the respective opening 73 in the right support track 62. The arcuate members 84 and 86 are then slid along the support tracks 61 and 62 until the worksurface 13 is in the desired tilt orientation. The pin 89 is repositioned and moved downward until it reengages one of the openings 73 in the right support track 62. Note that as illustrated in FIG. 10, if the shelves 91 are removable, they can be removed at this time to not interfere with the monitor support.

It should be appreciated that the foregoing description is for the purposes of illustration only, and further alternative embodiments of this invention are possible without departing from the scope of the claims. For instance, referring now to FIG. 11, an alternate embodiment of the workstation 10 is illustrated. The modified workstation 110 is virtually identical to the workstation 10 previously described. Thus, like components have been indicated by like reference numbers. However, in this embodiment, the arcuate support tracks 161 and 162 omit the upper arcs 68 of the workstation 10.

Figure 11:
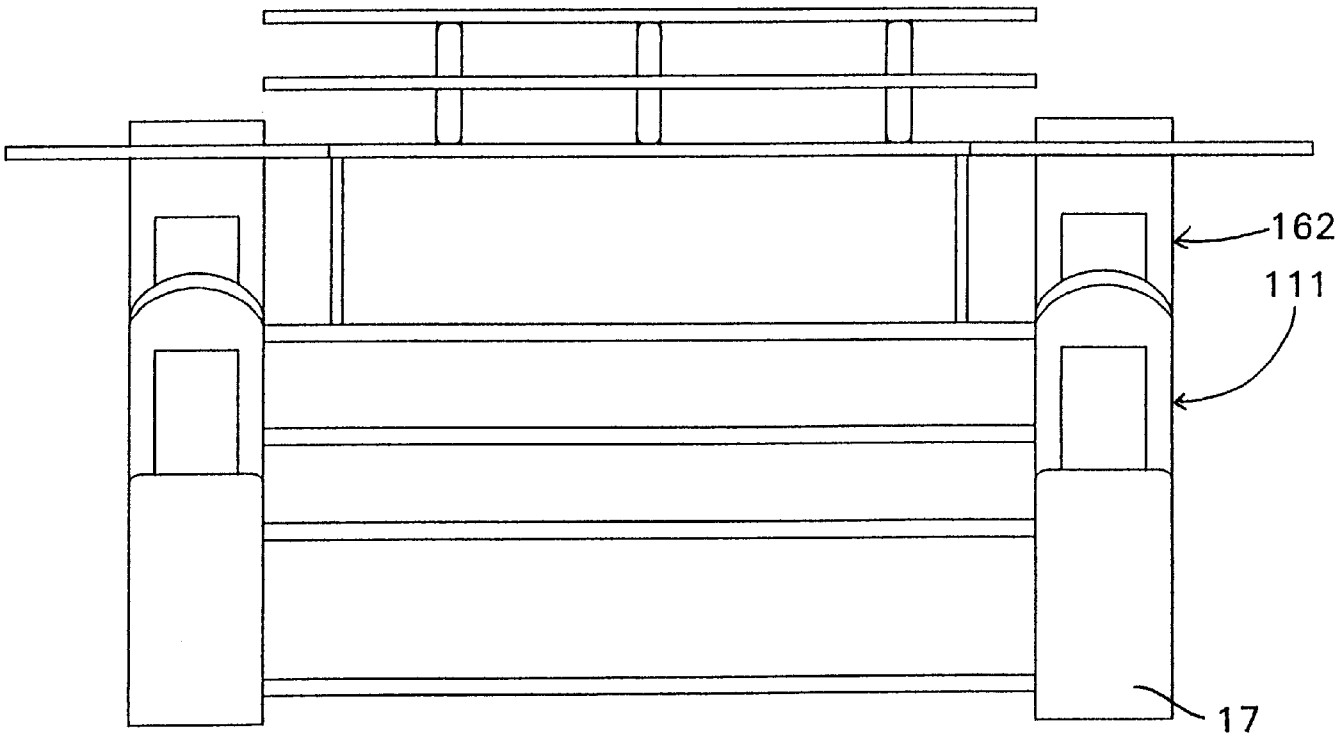
FIG. 11 is a front view of an alternate embodiment of the FIG. 1 workstation.
Figure 12:
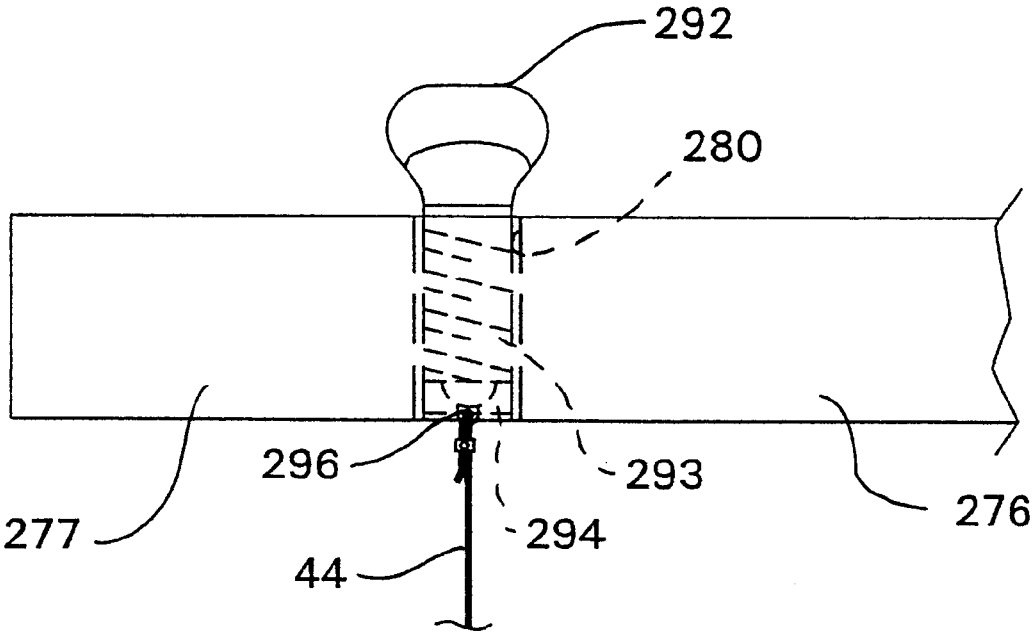
FIG. 12 is a top view of a cable tensioning device for an alternative embodiment of the present invention.

In addition to the modification illustrated in FIG. 11, the workstation of the present invention could be further modified. Referring to FIG. 12, an enlarged, partial view of an alternative embodiment of the rod 76 is illustrated. In particular, the left end 277 of rod 276 is shown. The rod 276 includes a bore 280. A bolt 292 has a shaft 293 that is positioned in the bore 280. An end piece 294 is attached to the end of the bolt shaft 293. The cable 44 extends into the bore 280, through the end piece 294 and is secured to the end of the bolt shaft 293 at an attachment point 296. After a significant period of use, the cable 44 can stretch. To tighten the cable 44, the bolt 292 is twisted once or twice in the bore 280 to wrap the cable 44 around the end of the shaft 293. By periodically tightening the cable 44 in this manner, the vertical orientation of the workstation 10 can remain unaffected by any stretching of the cable 44. It should be appreciated that while only the left end 277 of the rod 276 has been illustrated, a right end of the rod 276 would include a similar mechanism to remove slack from the cable 43 (not shown).

Figure 13:
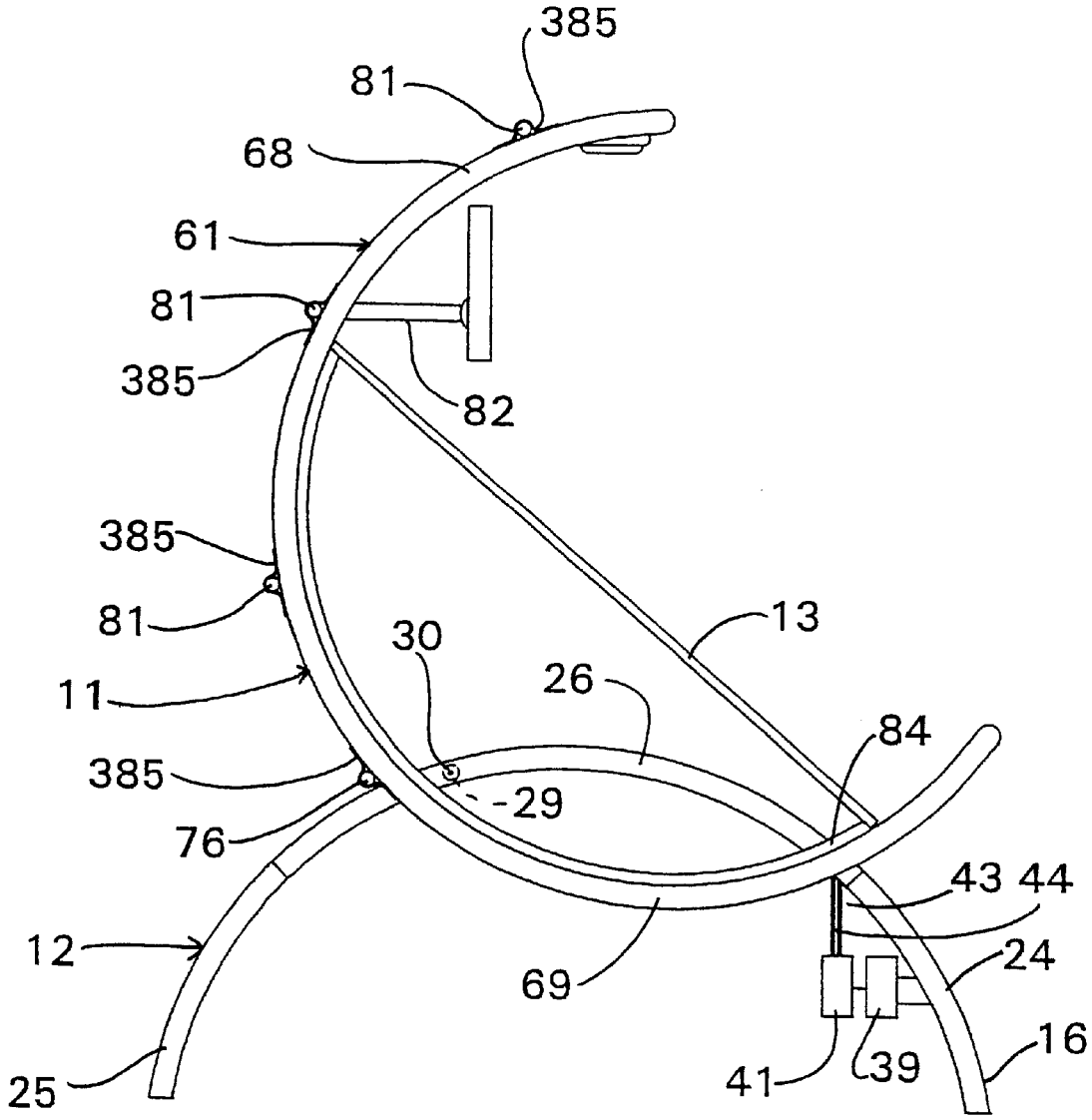
FIG. 13 is a side view of a further modification to the FIG. 1 workstation.

Further to the above modifications, the workstation of the present invention could be modified as illustrated in FIG. 13. In this modified embodiment, the ends of the rods 76 and 81 are not inserted into the left and right support tracks 61 and 62 as in the previous embodiments. Instead, the ends of the rods 76 and 81 are attached to the radially outwardly facing surface 64 of the respective support track 61 and 62 by brackets 385. By attaching the rods 76 and 81 to the outer surface 64 of the support tracks 61 and 62, the structural integrity of the support tracks will not be reduced as it might be by drilling the bores in these components in which the rod ends would seat in the prior embodiments.

In addition to the above disclosed modifications, the single elongate slot in the top surface of the right leg could be replaced by two parallel slots in that surface. Each cable could the move within a separate slot, thus reducing potential problems such as friction wear caused by the cables rubbing against one another. In addition, while not illustrated herein, it should be appreciated that bearing plates could be secured to the front segment of the support tracks to prevent-wear of these components that could occur when the front roller bearings roll over the radially outwardly facing support track surfaces. Bearing plates could also be attached to the top surface of the central segment of each leg to prevent similar wear on these surfaces from the back roller bearings.

Still further modifications of the present invention are possible. For instance, the disclosed cable drum and motor could be replaced by a hand crank assembly that could be operated for height adjustment of the worksurface. Further, while the motor and tilt adjustment mechanism have been disclosed attached to the right side of the workstation, it should be appreciated that the workstation of the present invention can be easily reconfigured to move these components to the left side. Still further, the tilt adjustment mechanism disclosed herein could be replaced with a motor and pulley system similar to the height adjustment mechanism. Thus, the height and tilt adjustment mechanisms can be located to more easily facilitate either a right or left handed user.

In addition to the above disclosed modifications to the present invention, still further modifications are possible. While the workstation has been illustrated herein with left and right arcuate support tracks and left and right legs that have equal radii, this could be altered. For instance, each of the left and right legs could have a radius that is greater than the radius of each of the left and right arcuate support tracks. However, when the radii are unequal, the worksurface will not remain in the same tilt orientation when the height of the workstation is adjusted. The greater the difference between the radius of each leg and the radius of each arcuate support track, the greater the change in tilt as the workstation height is adjusted. Therefore, in this alternative the workstation would need to include an additional mechanism to maintain the worksurface at the desired tilt orientation as the height of the workstation is adjusted.

Thus, although particular preferred embodiments of the present invention have been disclosed in detail for illustrative purposes, it will be recognized that variations or modifications lie within the scope of the present invention and do not depart from the spirit of the invention, as set forth in the foregoing description and drawings, and in the following claims.

What is claimed is:

1. An adjustable workstation comprising:

a base including first and second spaced apart arcuate legs having a common first radius;

a worksurface support assembly supported on said base and including first and second spaced apart arcuate supports, each support having a common second radius equal to said common first radius of the first and second legs;

elongate slots respectively extending through said first and second supports;

each of said first and second legs having a central segment that is received in a respective one of said elongate slots in said first and second supports;

said first support including a first arcuate member that is slidably fitted on a first support track and said second support including a second arcuate member that is slidably fitted on a second support track;

a worksurface secured to and supported by said first and second arcuate members; and a lift assembly configured to move said worksurface support assembly in a generally horizontal direction with respect to said base to vertically adjust said worksurface between upper and lower elevational positions.

2. The workstation according to claim 1, wherein said lift assembly includes first and second cables extending from a cable drum that is secured to said first leg near a front of said workstation; and said first and second cables are coupled to said first and second support tracks, respectively, near a back of said workstation.

3. The workstation according to claim 2, wherein said lift assembly includes a first pulley that is coupled to said first leg near said front of said workstation and is configured to rotate about a generally horizontal axis and second and third pulleys that are respectively coupled to said first and second legs near the middle of the workstation and are configured to rotate about generally vertical axes;

said first and second cables extend from said cable drum over said first pulley and along said first leg toward said second pulley;

said first cable further extends along said first leg and terminates at an attachment point on said first support track; and said second cable passes around said second pulley, extends toward said second leg, passes around said third pulley, extends over said second leg and terminates at an attachment point on said second support track.

4. The workstation according to claim 3, including a hollow rod extending between said first and second legs, said second cable extending through said hollow rod between said second and third pulleys.

5. The workstation according to claim 3, wherein an elongate rod extends between said first and second support tracks near said back of said workstation and has a first end inserted in said first support track and a second end inserted in said second support track; and said first attachment point is on said first end of said elongate rod and said second attachment point is on said second end of said elongate rod.

6. The workstation according to claim 3, wherein a motor is operably coupled to said cable drum and is configured to rotate said cable drum in a first direction in which said first and second cables are loosened from said cable drum and a second direction in which said first and second cables are tightened around said cable drum;

said worksurface support assembly is moved toward the back of the workstation to move the workstation toward said lower position when said cable drum is rotation in said first direction; and said worksurface support assembly is moved toward the front of the workstation to move the workstation toward said upper position when said cable drum is rotated in said second direction.

7. The workstation according to claim 1, wherein front bearings are attached to opposite sides of each of said first and second legs and rear bearings are attached to opposite sides of each of said first and second support tracks;

said first and second support tracks roll along said front roller bearings when said worksurface is moved between said upper and lower positions; and said rear roller bearings roll along said respective first and second legs when said worksurface is moved between said upper and lower positions.

8. The workstation according to claim 7, wherein guide bearings are movably positioned in slots in opposite sides of each of said first and second tracks; and each of said guide bearings roll in a respective one of said paths when said worksurface is moved between said upper and lower positions.

9. The workstation according to claim 1, wherein a removable pin extends through said first support member;

an upper surface of said first track includes a series of bores; a said pin is sized to engage one of said bores to lock said worksurface in an angular position.

10. The workstation according to claim 1, wherein said first and second support tracks are semi-circular in shape.

* * * * *

UNITED STATES PATENT AND TRADEMARK OFFICE

CERTIFICATE OF CORRECTION

PATENT NO. : 6,672,225 B2
DATED : January 6, 2004
INVENTOR(S) : Leonardo A. Pomodoro It is certified that error appears in the above-identified patent and that said Letters Patent is hereby corrected as shown below:

Title page,
Item [73], Assignee, change “Kalamaloo” to -- Kalamazoo --.

Column 10,
Line 30, change “bores; a” to -- bores; and --.

Signed and Sealed this

Twenty-ninth Day of June, 2004

JON W. DUDAS
*Acting Director of the United States Patent and Trademark Office*